United States Patent [19]

Williford

[11] 4,060,204

[45] Nov. 29, 1977

[54] CREMATED REMAINS PROCESSOR

[75] Inventor: Danny Franklin Williford, Miami, Fla.

[73] Assignee: No Flame Process, Inc., Miami, Fla.

[21] Appl. No.: 734,985

[22] Filed: Oct. 22, 1976

[51] Int. Cl.[2] ..... B02C 17/02

[52] U.S. Cl. ..... 241/74; 241/171; 241/179

[58] Field of Search ..... 241/74, 170, 171, 172, 241/176–180

[56] References Cited

U.S. PATENT DOCUMENTS

| | | | |
|---|---|---|---|
| 3,015,451 | 1/1962 | Goeser | 241/176 X |
| 3,186,647 | 6/1965 | Bacher | 241/171 X |
| 3,601,323 | 8/1971 | Glencke | 241/179 X |
| 3,837,301 | 9/1974 | Falling | 241/171 X |
| 3,862,719 | 1/1975 | Myller | 241/74 |

*Primary Examiner*—Joseph H. McGlynn
*Assistant Examiner*—Howard N. Goldberg
*Attorney, Agent, or Firm*—Flehr, Hohbach, Test, Albritton & Herbert

[57] ABSTRACT

Apparatus for processing cremated remains. A hollow drum is mounted for rotation within a housing with an open end of the drum positioned in register with the discharge opening of a detachable loading funnel. A plurality of elongate rods carried within the drum are constrained at their opposite ends by channels so as to undergo relative movement with the inner periphery of the drum. The rod diameters are sized so that they tumble one over the other as the drum rotates for reducing fragments of the cremated remains which are charged into the drum through the loading funnel. The reduced remains drop through apertures in the drum into a discharge funnel and ash pan where they are collected for subsequent removal.

8 Claims, 4 Drawing Figures

CREMATED REMAINS PROCESSOR

BACKGROUND OF THE INVENTION

This invention relates in general to the processing of dry bone fragments, commonly called cremated remains, and particularly to the size reduction of cremated remains.

Heretofore there have been employed various methods and apparatus for reducing the size of cremated remains. Many of these prior apparatus have in practice proved to be either impractical or prohibitive in cost. For example, mills employing steel balls have been provided, but such apparatus are relatively costly, and the operation of them can result in damage or failure due to the presence of non-ferrous metal often found in the cremated remains, such as from materials used in construction of a casket or container or from prosthesis where the body has been the subject of orthopedic surgery. The need is therefore recognized for cremated remains processing apparatus which will obviate the problems and short-comings of existing apparatus of this type.

OBJECTS AND SUMMARY OF THE INVENTION

It is a general object of the invention to provide a new and improved apparatus for reducing cremated remains.

Another object is to provide apparatus of the type described which will reduce dry bone fragments to a size which is more easily packaged for final disposition, and to a size which is also less repugnant in appearance and will be more acceptable to the nearest of kin.

It is a further object to provide apparatus of the type described which is relatively inexpensive in design and construction and which can be economically and efficiently operated.

Another object is to provide apparatus of the type described which can be relatively easily and inexpensively modified during assembly for reducing the cremated remains to a specified size that is required to conform to varying standards which exist in different localities.

Another object is to provide apparatus of the type described which is capable of operating in a manner to minimize mechanical malfunctions which could otherwise result from the presence of non-ferrous metal which may be in the cremated remains.

The invention in summary includes a housing in which a hollow drum is mounted to be rotatably driven by a motor. An open end of the drum is in register with a discharge opening of a loading funnel into which a charge of cremated remains is introduced. A plurality of elongate steel rod are constrained for relative movement about the inner periphery of the drum by means of annular channels. Certain of the rods are of disparate diameters so that they react with the drum and tumble one over the other for reducing the size of the cremated remains. The reduced particles of remains pass through apertures formed in the drum and fall into a discharge funnel and thence into an ash pan where they are collected for subsequent removal. The loading funnel is detachably mounted to permit access into the drum for purposes of maintenance, cleaning and removal of metal fragments.

The foregoing and additional objects and features of the invention will become apparent from the following description in which the preferred embodiments have been set forth in detail in conjunction with the accompanying drawings.

DESCRIPTION OF THE PREFERRED EMBODIMENTS

Figure 1:
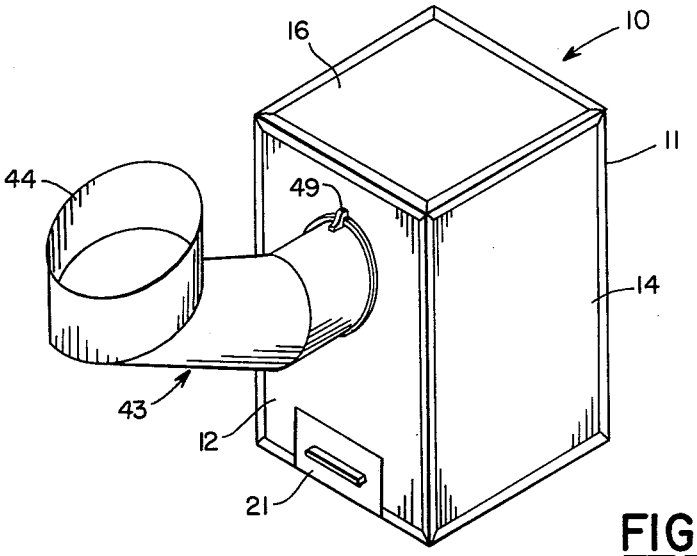
FIG. 1 is a perspective view of apparatus incorporating a preferred embodiment of the invention.
Figure 2:
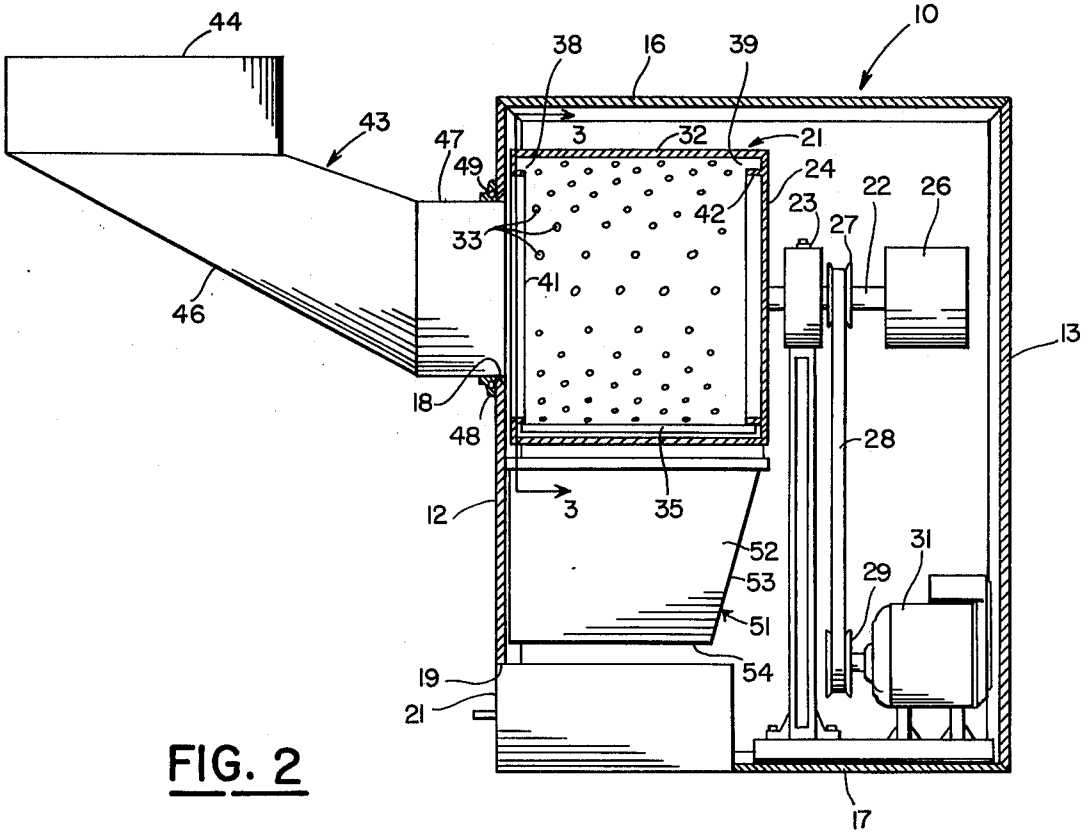
FIG. 2 is a longitudinal sectional view of the apparatus of FIG. 1.

In the drawings FIGS. 1 and 2 illustrate generally at 10 a preferred embodiment of cremated remains reducing apparatus according to the invention.

Apparatus 10 includes a generally box-like housing 11 comprising front and rear panels 12, 13, side panels 14 and top and bottom panels 16, 17. The front panel is formed at its upper end with a circular entry opening 18, and at its lower margin with a rectangular opening 19 through which an ash collection pan 21 is adapted to be inserted and removed.

A reducing drum 21 is provided within the housing, and the drum is mounted for rotation about its longitudinal axis by means of an axle 22 which is carried on a center bearing 23. One end of the axle is attached to a circular end wall 24 of the drum, and the opposite end of the axle carries a counter-balance weight 26. A driven pulley 27 is keyed for rotation on the axle, and a belt 28 drives pulley 27 from a pulley 29 mounted on the drive shaft of a suitable electric motor 31. An on-off switch and timer switch, e.g. a 5 minute timing switch, not shown, can be provided for operating the motor to drive the drum for rotation at a suitable speed on the order of 35 RPM.

The drum 21 is formed with a cylindrical shell 32 secured at one end to end plate 24. The opposite end of the shell is open and is in register with entry opening 18 of the housing for receiving a charge of cremated remains. A plurality of apertures 33 are formed in spaced relationship about the drum for passing reduced cremated remains out of the drum. The diameter of the apertures is selected, depending upon the particular specifications of the user, to produce the desired size reduction for conforming to the varying standards which exist in different localities. For example, the drum apertures could be in the range of $1\frac{1}{8}$ inch to $3\frac{1}{8}$16 inch diameter. A number of circular shells having apertures of different sizes could be provided so that during final assembly the shell with the desired aperture size would be utilized, thereby broadening the range of use and reducing manufacturing costs.

A plurality of elongate steel rods 35, 36, 37 are contained within the shell for reducing the particle size of the cremated remains. The lengths of the rods are commensurate with the inner length of the drum so that the rods do not tend to cock as the drum is rotated. The rods are constrained for relative rotation about the inner periphery of the drum by means of annular channels 38, 39 provided at opposite ends of the drum. The channels are formed by inwardly directed flanges 41, 42 which are radially spaced from the inner periphery of the drums. Two or more of the rods are of disparate diameter, and the rod diameters are sized so that there is sufficient clearance with the width of the channels to permit the rods to tumble one over the other within the channels as the drum is rotated. By way of example, the illustrated embodiment provides a single large rod 35 of 1 diameter ($d_1$), two medium sized rods 36 of 3⅜8 diameter ($d_2$) and three small rods 37 of 3⅜16 diameter ($d_3$). The specific number of the large, medium and small rods can be varied as desired. In this example the width 40 of the channels is 1½ inches. This leaves a ½ inch clearance between the large rod and channel walls to permit the different rods to pass by one another in the channels.

A detachable loading funnel 43 is provided for introducing a charge of cremated remains into the reducing drum. The loading funnel includes an open upper end 44, a downwardly inclined spout 46 and a circular collar 47 forming a discharge opening of a size commensurate with entry opening 18 of the housing. Suitable quick-released fastener devices 48, 49 are provided for detachably mounting the loading funnel on the housing. Release of the fastener devices permits access into the reducing drum for purposes such as maintenance, cleaning and removal of any remaining metal fragments. Collar 47 of the loading funnel is positioned so as to incline down at a small angle from the horizontal toward the entry opening so as to promote movement of the cremated remains charge into the drum.

An upwardly open discharge funnel 51 is mounted within the housing behind front panel 12 in vertical register below the drum. The discharge funnel is formed with a pair of inwardly sloping side walls 52 and an inwardly sloping rear wall 53. These walls are joined together to define a rectangular lower opening 54 sized commensurate with the ash pan for discharging the reduced remains into the pan.

Figure 3:
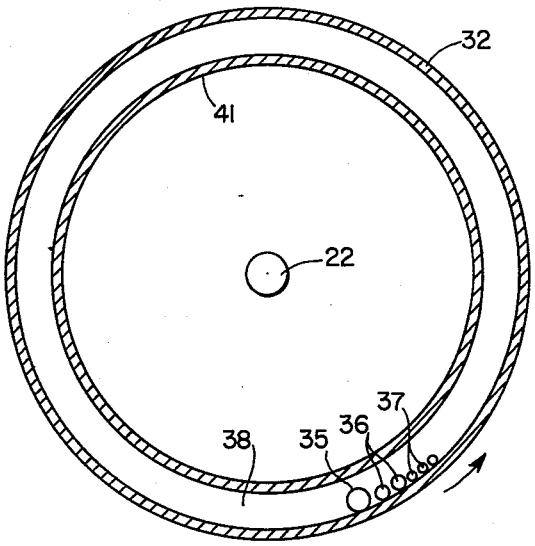
FIG. 3 is a cross-sectional view taken along the line 3—3 of FIG. 2.
Figure 4:
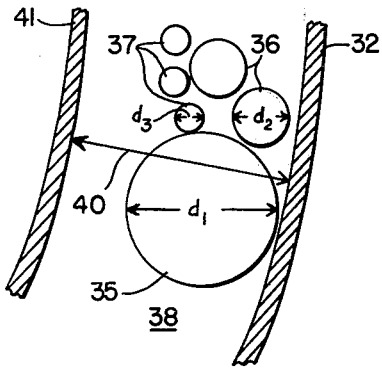
FIG. 4 is an enlarged fragmentary view showing the size relationship of several of the rods relative to a channel of the reducing drum of the apparatus.

In operation, motor 31 is energized for driving pulley 27 and rotating reducing drum 21 at a speed of 35 RPM for the desired time, e.g. 5 minutes. The charge of cremated remains is introduced through loading funnel 43 into the reducing drum. As the drum rotates counterclockwise as illustrated in FIG. 3, the reaction against the upwardly moving shell rotates the rods. The different diameters of the rods causes them to turn at different rates so that they tumble one over the other relative to the shell. The tumbling rods strike the cremated remains which are thereby reduced by impact and attrition. Any metal particle which may be contained within the remains can be detected by the operator from the sounds made within the drum. The reduced remains pass through the apertures in the shell and drop down into discharge funnel 51 which directs them into the collection pan for subsequent removal after drum rotation is stopped. The operator can detach loading funnel from the housing and gain entry into the shell for removal of the metal particles.

While the embodiment herein is at present considered to be preferred, it will be understood that numerous variations and modifications may be made therein by those skilled in the art, and it is intended to cover in the appended claims all such variations and modifications as fall within the true spirit and scope of the invention.

What is claimed is:

1. Apparatus for reducing cremated remains including the combination of a housing having an entry opening for receiving a charge of the remains, a hollow reducing drum mounted for rotation about is longitudinal axis within the housing, said drum including an outer cylindrical shell formed with a plurality of apertures sized for passing fragments of the remains below a predetermined size, the shell further including an end opening positioned in register with the entry opening of the housing for receiving the charge of remains, means for rotating the drum about its longitudinal axis, a plurality of elongate rods carried within the drum, at least certain of the rods having disparate diameters, means for constraining the rods for relative movement about the inner periphery of the drum whereby the rods are caused to react with the rotating shell of the drum and tumble one over the other for progressively reducing the remains to a size for passing through the apertures, and means for collecting the remains which pass through the apertures.

2. Apparatus as in claim 1 in which the means for constraining the rods comprises annular flange means formed on opposite ends of the drum with the flange means projecting inwardly from the ends in spaced-apart relationship with the inner periphery of the shell to define channels for supporting opposite ends of the rods for said relative movement about the periphery of the drum.

3. Apparatus as in claim 2 in which the flange means is spaced from the inner periphery of the drum a distance greater than the sum of the diameters of the rods of disparate diameters whereby the rods are free to tumble past one another in the channels.

4. Apparatus as in claim 3 which includes a loading funnel having a downwardly inclined spout terminating with a discharge opening sized commensurate with the entry opening of the housing, and means for detachably connecting the discharge opening of the spout on the housing about said entry opening whereby the funnel can be removed to permit access into the drum for purpose such as cleaning and removal of any metal fragments.

5. Apparatus as in claim 4 in which the collection means includes discharge funnel means mounted in the housing below the drum for receiving the reduced remains which drop by gravity from the apertures, said discharge funnel being formed with an opening at its lower end, and a collection pan removably mounted in the housing below the opening of the discharge funnel for receiving the remains discharged therefrom.

6. Apparatus as in claim 3 in which the plurality of rods includes a single rod having a diameter greater than one-half of said distance spacing of the flange means from the shell, together with at least two additional rods having diameters permitting the additional rods to move in the clearances between the single rod and the channels.

7. Cremated remains processing apparatus comprising a drum having a cylindrical wall formed with a plurality of apertures, said apertures being sized for passing cremated remains fragments which are smaller than a predetermined size, one end of said drum being formed with an entry opening for receiving a charge of cremated remains, means forming annular flanges about opposite ends of the drum with the flanges projecting inwardly of the drum ends in spaced-apart relationship with the cylindrical wall to form channels therewith, a plurality of elongate cylindrical rods mounted within the drum with their opposite ends supported for relative movement within the channels, at least a pair of the rods being of disparate diameters whereby reaction of the rods with the cylindrical wall during rotation of the drum causes the rods to disparate diameters to rotate at different rates and tumble one over the other for reducing the cremated remains, means for rotating the drum, and collection means mounted below the drum for collecting the remains which pass through the apertures.

8. Apparatus as in claim 7 which includes a loading funnel having a downwardly inclined spout terminating with a discharge opening, and means for detachably mounting the funnel with its discharge opening in register with the shell, said funnel being removeable for permitting access into the shell for removal of metal fragments therefrom.

* * * * *